US005916275A

United States Patent [19]

Chung

[11] Patent Number: 5,916,275

[45] Date of Patent: Jun. 29, 1999

[54] PULSATOR FOR A WASHING MACHINE

[75] Inventor: Ui-Shik Chung, Seoul, Rep. of Korea

[73] Assignee: Daewoo Electronics Co., Ltd., Seoul, Rep. of Korea

[21] Appl. No.: 08/990,086

[22] Filed: Dec. 12, 1997

[30] Foreign Application Priority Data

Feb. 14, 1997 [KR] Rep. of Korea ..... 97-2254 U

[51] Int. Cl.[6] ..... D06F 17/10

[52] U.S. Cl. ..... 68/134; 68/133

[58] Field of Search ..... 68/133, 134, 53

[56] References Cited

U.S. PATENT DOCUMENTS

| | | | |
|---|---|---|---|
| 2,009,111 | 7/1935 | Kirby | 68/133 |
| 2,167,147 | 7/1939 | Frantz | 68/133 |
| 2,310,950 | 2/1943 | Goldman | 68/133 |
| 2,598,057 | 5/1952 | Horvath | 68/133 |
| 4,175,409 | 11/1979 | Morey . | |
| 5,727,404 | 3/1998 | Cho | 68/133 |

FOREIGN PATENT DOCUMENTS

| | | | |
|---|---|---|---|
| 477945 | 2/1953 | Italy | 68/133 |
| 61-222599 | 6/1986 | Japan | 68/133 |
| 63-95084 | 4/1988 | Japan | 68/133 |
| 2 308 136 | 6/1997 | United Kingdom . | |
| WO 93 1325 | 7/1993 | WIPO . | |

*Primary Examiner*—Frankie L. Stinson
*Attorney, Agent, or Firm*—Pillsbury Madison & Sutro LLP

[57] ABSTRACT

A pulsator of a washing machine for effectively washing small-sized or light weight articles. The pulsator has a rotating disc, and a cylindrical member having a chamber for receiving an article to be washed and integrally formed at a center of an upper surface of the rotating disc. The cylindrical member extends upward by a predetermined length. The pulsator has a lid for preventing the article received in the chamber from coming out of the chamber, and a plurality of vanes for generating a swirl shaped liquid flow. The vanes are regularly installed around an outer wall of the cylindrical member. The cylindrical member is formed at its outer wall with a plurality of holes for introducing/discharging a washing water into/from the chamber. The articles placed in the chamber of the pulsator are subjected to a relatively small centrifugal force, so the small-sized articles can be prevented from tangling with each other and prevented from being damaged. The pulsator has a simple construction and can be easily manufactured by molding process, so the manufacturing cost thereof is reduced.

4 Claims, 3 Drawing Sheets

PULSATOR FOR A WASHING MACHINE

BACKGROUND OF THE INVENTION

1. Field of the Invention

The present invention relates to a washing machine, and more particularly to a washing machine having a pulsator formed at its inside with a chamber for separately receiving delicate articles or small-sized articles to be washed.

2. Prior Arts

As is well known, a washing machine is an appliance for separating dirt from articles to be washed such as clothing by sequentially carrying out various cycles in the order of liquid feeding, washing, rinsing, dehydrating, and draining cycles.

While the above cycles are being executed, dirt contained in the articles separates from the articles by means of friction between a liquid flow and the articles or by means of detergents.

FIG. 3 shows such a conventional washing machine 500.

As shown in FIG. 3, conventional washing machine 500 includes a housing 510. An outer tub 520 for receiving a washing liquid is disposed in housing 510. Enclosed within outer tub 520 is a spin tub 530 formed at its side wall with a plurality of discharging holes 532. Below outer tub 520 but within housing 510, there are provided a motor 540 for generating a driving force, and a gear assembly 550 which transfers the driving force of motor 540 to spin tub 530 or to a pulsator 560 rotatably mounted on a bottom wall of spin tub 530.

While the washing cycle is being carried out, pulsator 560 driven by motor 540 rotates in forward and reverse directions, thereby creating a swirl-shaped liquid flow in spin tub 530. The swirl-shaped liquid flow collides with the articles in spin tub 530, so the articles are washed.

However, in conventional washing machine 500, the swirl-shaped liquid flows generated by pulsator 560 become weak as they reach an upper portion of spin tub 530 due to an interference by the articles. For this reason, when a large amount of articles are placed in spin tub 530, the washing effect at the upper portion of spin tub 530 is reduced. Particularly, articles having a light weight or a small size are not completely immersed in the washing liquid, but float on the surface of the washing liquid in the direction of the liquid flow. As a result, the small-sized articles do not widely collide with the liquid flow, so the dirt contained in the small-sized articles is not completely separated from the articles.

In order to solve the above problem, various washing machines have been suggested, but they have presented many problems.

For example, U.S. Pat. No. 4,175,409 issued to Morey discloses a washing machine which can effectively wash articles having a light weight.

Morey's washing machine comprises a small basket fixedly installed at an upper portion of an agitator. The small basket is formed with a plurality of pores, so washing water is introduced/discharged into/from the small basket through the pores. In washing cycle, the small basket having light weight articles therein rotates together with the agitator, so the articles placed in the small basket are washed.

However, since the small basket is installed at the upper portion of the agitator in Morey's washing machine, the small basket may interrupt the rotation of the agitator. In addition, the small basket may collide with articles placed in a spin tub while the washing cycle is being performed, so the rotation of the agitator is further interrupted and a motor for rotating the agitator is subjected to an overload.

SUMMARY OF THE INVENTION

The present invention has been made to overcome the above described problems of the prior art, and accordingly, it is an object of the present invention to provide a pulsator for a washing machine which can effectively wash small-sized or light weight articles and has a simple construction.

To achieve the above object, the present invention provides a pulsator for a washing machine, the pulsator comprising:

- a rotating disc;
- a cylindrical member integrally formed at a center of an upper surface of the rotating disc, the cylindrical member extending upward by a predetermined length and having a chamber for receiving an article to be washed therein;
- a first means for preventing the article received in the chamber from coming out of the chamber; and
- a plurality of vanes for generating a swirl shaped liquid flow, the vanes being regularly installed around an outer wall of the cylindrical member.

According to the preferred embodiment of the present invention, the cylindrical member is formed at its outer wall with a plurality of holes for introducing/discharging a washing water into/from the chamber.

The first means include a hemisphere lid which is detachably coupled to an upper surface of the cylindrical member.

The pulsator comprises a second means for hingedly coupling the hemisphere lid to the upper surface of the cylindrical member.

The second means includes a pair of links integrally formed at the upper surface of the cylindrical member, a projection which is integrally formed at the underside of the hemisphere lid and interposed between the pair of links, and a hinge pin for coupling the pair of links with the projection.

When it is required to wash delicate or small-sized articles, a user opens the hemisphere lid and places the small-sized articles into the chamber of the pulsator.

Then, if the user pushes an operating button installed on a control panel, the washing liquid is introduced into an outer tub.

When the liquid level in the outer tub reaches the predetermined liquid level, a liquid feed control valve blocks a liquid feeding pipe, so the washing liquid stops being supplied into the outer tub. At the same time, a motor rotates in forward and reverse directions thereby performing the washing cycle.

When the pulsator rotates in the forward or reverse direction, the articles placed in the spin tub move in forward or reverse direction in accordance with the direction of the liquid flow. The articles moving along the liquid flow are subjected to centrifugal force by the rotation of the pulsator so that the articles collide with an inside wall of the spin tub, thereby effectively removing dirt from the articles.

At the same time, the small-sized articles placed in the chamber of the pulsator are also agitated within the chamber. However, the articles placed in the chamber are subjected to a relatively small centrifugal force, so the small-sized articles can be prevented from tangling with each other and prevented from being damaged.

While the washing cycle is being performed, washing liquid is continuously introduced/discharged into/from the chamber through the holes, so the articles placed in the chamber collide with an inner wall of the pulsator so that the articles are effectively washed.

As described above, the pulsator of the present invention separately receives and washes delicate or small-sized articles, which are floating on the surface of the washing liquid in the direction of the liquid flow if they are placed in the spin tub, so the washing effect thereof is improved.

Furthermore, the articles placed in the chamber of the pulsator are subjected to relatively small centrifugal force, so the small-sized articles can be prevented from tangling with each other and prevented from being damaged.

In addition, the pulsator of the present invention has a simple construction and can be easily manufactured by molding process, so the manufacturing cost thereof is reduced.

BRIEF DESCRIPTION OF THE DRAWINGS

The above object and other advantages of the present invention will become more apparent by describing in detail a preferred embodiment with reference to the attached drawings, in which.

DESCRIPTION OF THE PREFERRED EMBODIMENT

Hereinafter, a preferred embodiment of the present invention will be described in detail with reference to the accompanying drawings.

Figure 1:
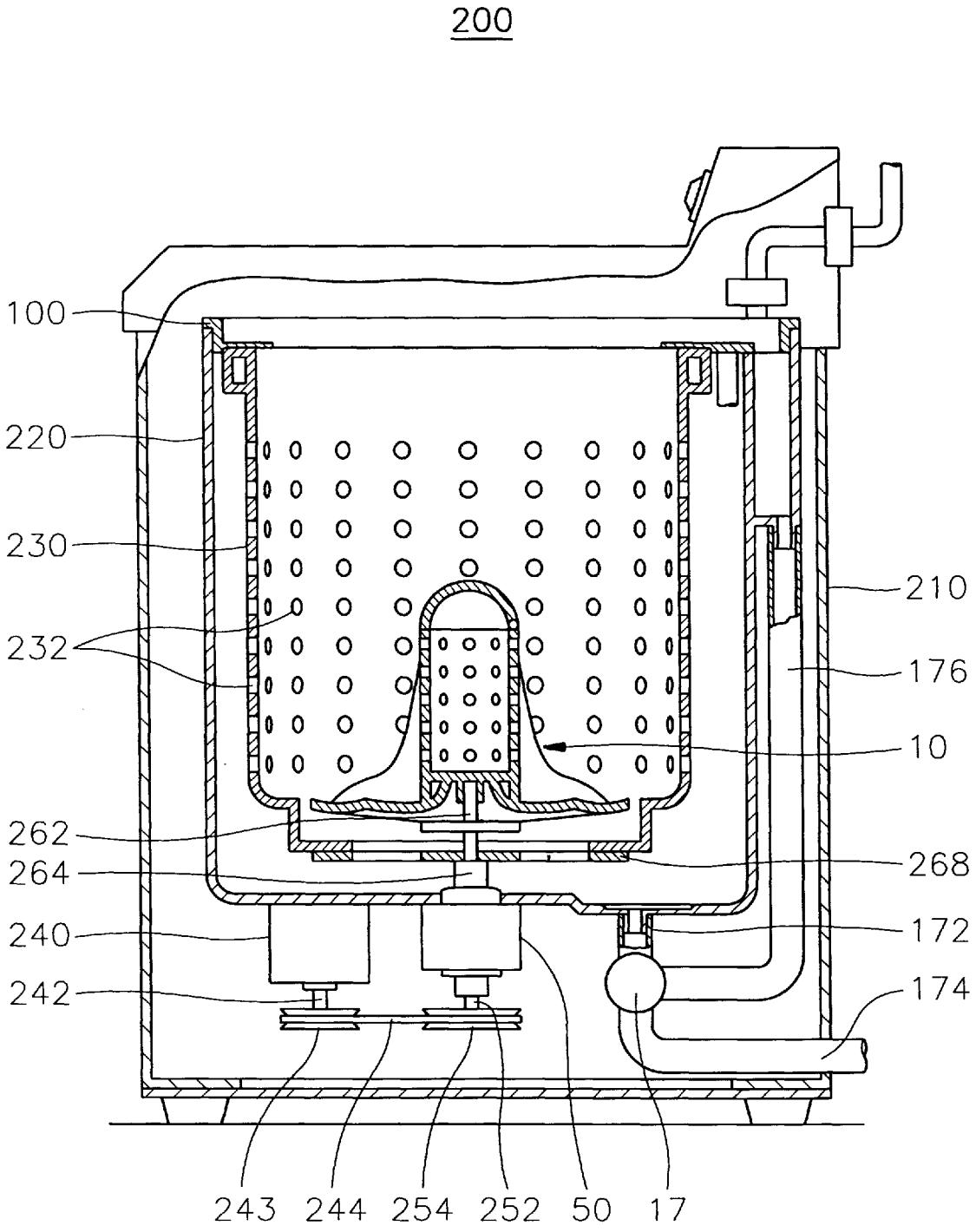
FIG. 1 is a sectional view showing the structure of a washing machine having a pulsator according to one embodiment of the present invention.

FIG. 1 shows a washing machine 200 having a pulsator 10 according to one embodiment of the present invention.

As shown in FIG. 1, washing machine 200 includes a housing 210. An outer tub 220 for receiving a washing liquid is disposed in housing 210. Enclosed within outer tub 220 is a spin tub 230 formed at its side wall with a plurality of discharging holes 232. Pulsator 10 of the present invention is rotatably mounted on a bottom portion of spin tub 230. The structure of pulsator 10 will be more detailedly described below with reference to FIG. 2.

Disposed below outer tub 220 are a motor 240 generating a rotational force for operating washing machine 200, and a gear assembly 250 which receives the rotational force from motor 240 and then transmits the rotational force to spin tub 230 or to pulsator 10.

When a washing cycle is being carried out, gear assembly 250 transmits the rotational force of motor 240 to pulsator 10 through a pulsator rotating shaft 262. In addition, when a dehydrating cycle is being carried out, gear assembly 250 transmits the rotational force of motor 240 to spin tub 230 through a connection member 264 and a rotating plate 268 which is fixedly attached to the underside of spin tub 230.

A spraying nozzle assembly 100 is mounted on an upper portion of outer tub 220 so as to spray the washing liquid onto the articles. A circulation pump 170 is disposed at a lower portion of housing 210. Circulation pump 170 is communicated with outer tub 220 so as to circulate the washing liquid into spraying nozzle assembly 100 or so as to drain the washing liquid out of washing machine 200 through a drain tube 174.

Motor 240 has a motor shaft 242 which is formed at its lower end with a first pulley 243. Gear assembly 250 has a rotating shaft 252 which is formed at its lower end with a second pulley 254. Second pulley 254 is connected to first pulley 243 by a belt 244 in such a manner that the rotational force of motor 240 can be transmitted to gear assembly 250.

In addition, circulation pump 170 has a pump motor (not shown) therein and is connected to outer tub 220 through a discharging tube 172 so as to receive the washing liquid from outer tub 220. Circulation pump 170 is also connected to spraying nozzle assembly 100 through a circulation tube 176 so that the circulated washing liquid is sprayed into spin tub 230.

Hereinafter, the structures of pulsator 10 will be explained.

Figure 2:
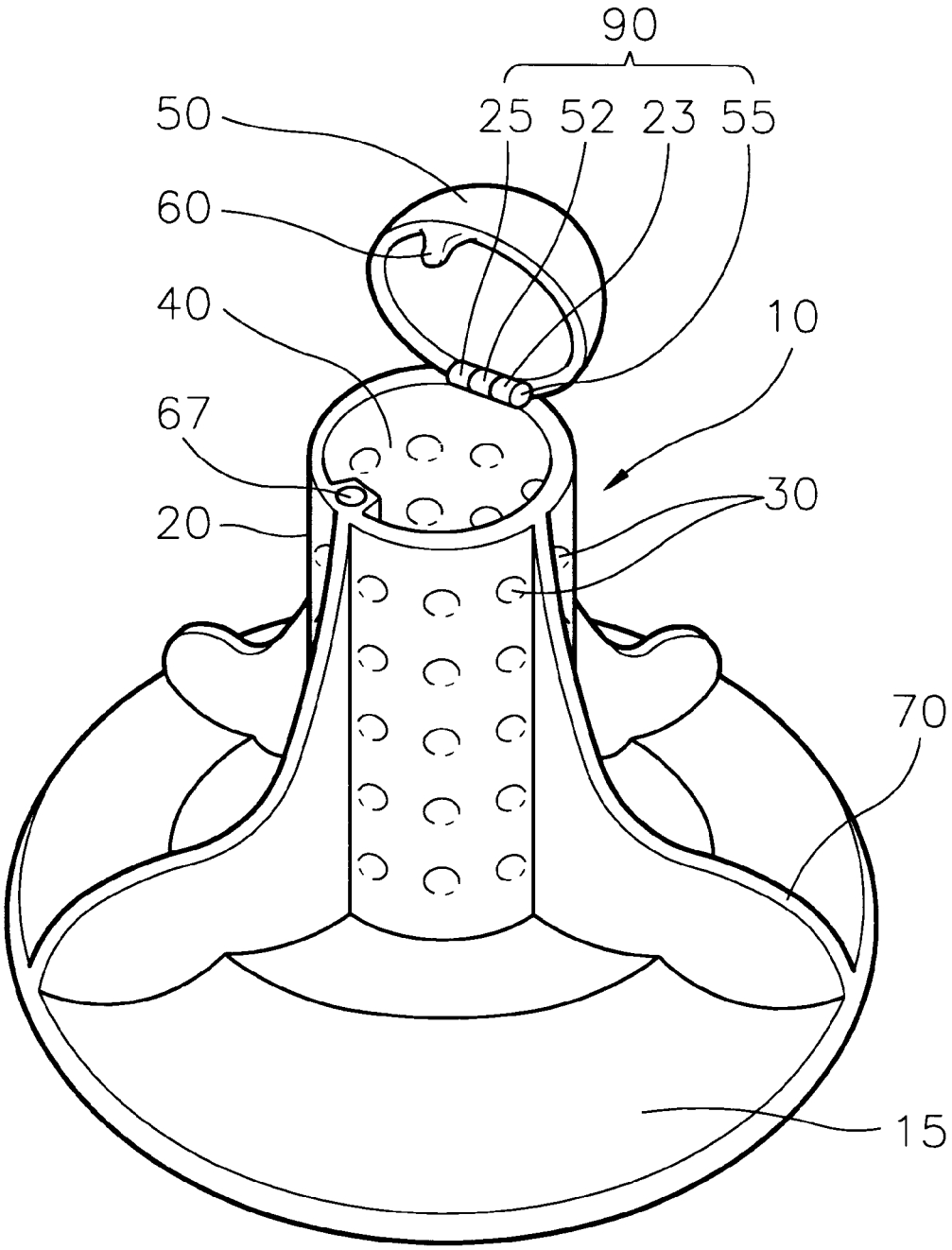
FIG. 2 is a perspective view showing a pulsator according to the present invention.
Figure 3:
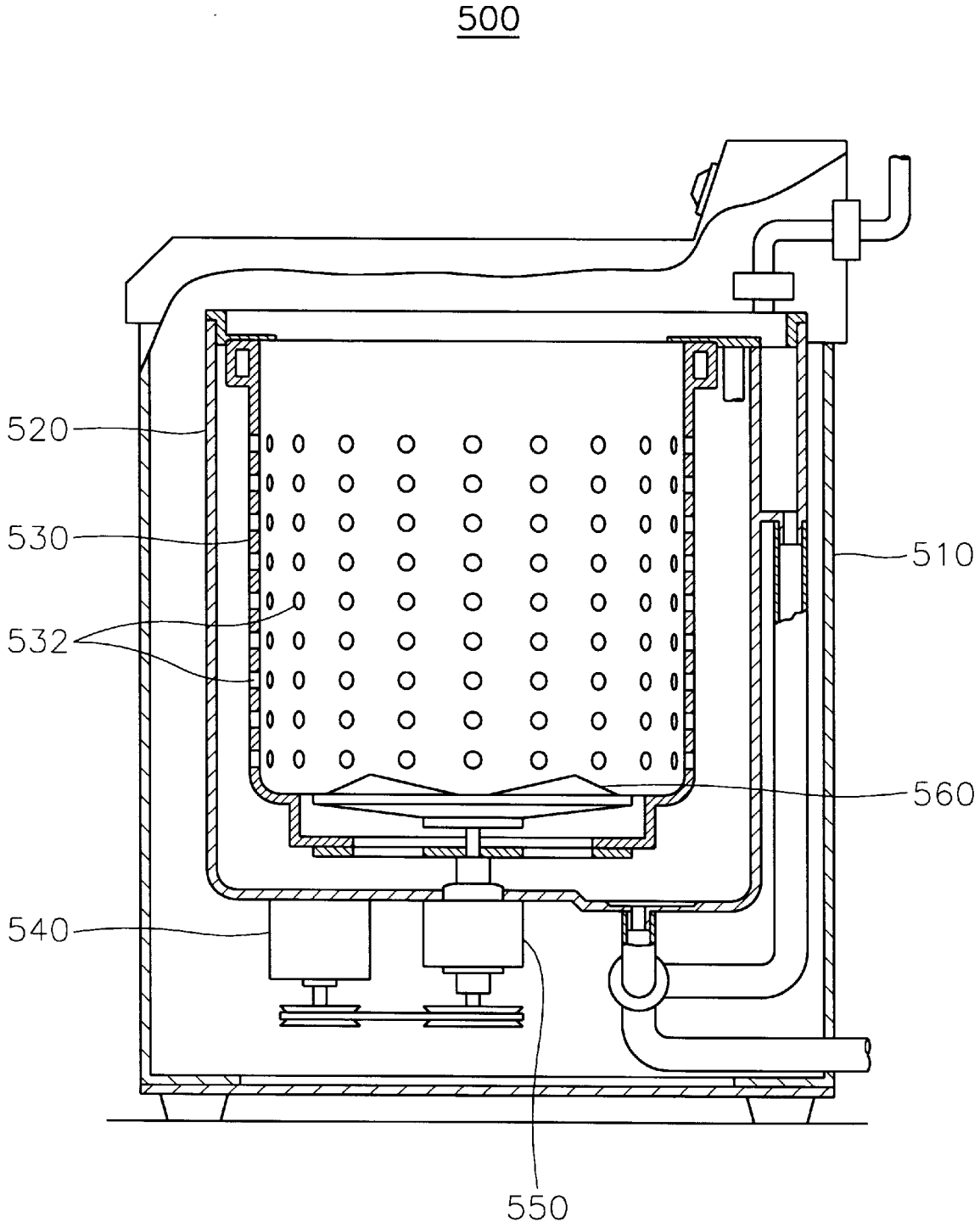
FIG. 3 (PRIOR ART)
FIG. 3 is a partially sectional view showing the structure of a conventional washing machine.

As shown in FIG. 2, pulsator 10 has a rotating disc 15 which is connected to pulsator driving shaft 262. A cylindrical member 20 having a chamber 40 for receiving an article to be washed is integrally formed at a center of an upper surface of rotating disc 15. Cylindrical member 20 extends upward by a predetermined length from the upper surface of rotating disc 15 and has an opening at an upper surface thereof so as to allow the articles to be placed in chamber 40.

A plurality of vanes 70 for generating a swirl shaped liquid flow in spin tub 230 are regularly installed around an outer wall of cylindrical member 20. According to a preferred embodiment of the present invention, pulsator 10 has four vanes 70 which are regularly spaced apart from each other at an angle of 90 degrees. Cylindrical member 40 is formed at its outer wall with a plurality of holes 30 for introducing/discharging a washing water into/from chamber 40.

In addition, in order to prevent the article received in chamber 40 from coming out of chamber 40, a lid 50 is detachably coupled to the upper surface of cylindrical member 20. Preferably, lid 50 has a hemisphere shape so as to reduce friction between lid 50 and the articles being washed.

In order to allow lid 50 to be detachably coupled to cylindrical member 20, cylindrical member 20 is formed at the upper surface thereof with a locking hole 67, and hemisphere lid 50 is integrally formed at a predetermined portion of an underside thereof with a locking pin 60 which is detachably engaged with locking hole 67.

Pulsator 10 according to the present invention further comprises a hinge assembly 90 for hingedly coupling hemisphere lid 50 to the upper surface of cylindrical member 20. Hinge assembly 90 includes a pair of links 23 and 25 which are integrally formed at the upper surface of cylindrical member 20, a projection 52 which is integrally formed at the underside of hemisphere lid 50 and interposed between the pair of links 23 and 25, and a hinge pin 55 for coupling the pair of links 23 and 25 with projection 52.

Preferably, the pair of links 23 and 25 are disposed opposite to locking hole 67, and projection 52 is disposed opposite to locking pin 60.

Washing machine 200 having pulsator 10 constructed as described above operates as follows.

When it is required to wash small-sized articles, such as socks or a handkerchief made of silk or a synthetic fiber, a user opens hemisphere lid 50 and places the small-sized articles into chamber 40 of pulsator 10. At this time, other articles are placed in spin tub 230.

Then, if the user pushes an operating button installed on a control panel, the washing liquid is introduced from a liquid source into outer tub 220 until a liquid level in outer tub 220 reaches a predetermined level.

When the liquid level in outer tub 220 reaches the predetermined liquid level, a liquid feed control valve blocks a liquid feeding pipe, so the washing liquid stops being supplied into outer tub 220. At the same time, motor 240 rotates in the forward and reverse directions. The rotational force of motor 240 is transmitted to pulsator 10 by way of motor shaft 242, first pulley 243, belt 244, second pulley 254, gear assembly 250, and pulsator driving shaft 262. As a result, pulsator 10 rotates in forward and reverse directions, thereby generating the swirl-shaped liquid flow in spin tub 230.

When pulsator 10 rotates in the forward or reverse direction, the articles placed in spin tub 230 move in forward or reverse direction in accordance with the direction of the liquid flow. The articles moving in accordance with the direction of the liquid flow are subjected to centrifugal force by the rotation of pulsator 10 so that the articles collide with an inside wall of spin tub 230, thereby effectively removing dirt from the articles.

At the same time, the small-sized articles placed in chamber 40 of pulsator 10 are also agitated within chamber 40 due to the rotation of pulsator 10. However, the articles placed in chamber 40 are subjected to a relatively small centrifugal force, so the small-sized articles can be prevented from tangling with each other and prevented from being damaged.

While the washing cycle is being performed, washing liquid is continuously introduced/discharged into/from chamber 40 through holes 30, so the articles placed in chamber 40 collide with an inner wall of pulsator 10 so that the articles are effectively washed.

In addition, while the washing cycle is being carried out, circulation pump 170 operates according to a predetermined algorithm, so some of the washing liquid that has been introduced into outer tub 220 is discharged from outer tub 220 into circulation pump 170 through discharging tube 172. Upon receiving the washing liquid, circulation pump 170 compresses the washing liquid and circulates the washing liquid through circulation tube 176 into spraying nozzle assembly 100 mounted on the upper portion of outer tub 220. Spraying nozzle assembly 100 strongly sprays the circulated washing liquid onto the articles in spin tub 230, thereby further improving the washing effect.

When the washing cycle has finished, the pump motor rotates in the reverse direction. At this time, a first valve disposed between circulation pump 170 and circulation tube 176 is closed, and a second valve disposed between circulation pump 170 and drain tube 174 is opened. Accordingly, the washing liquid filled in outer tub 220 is drained out of washing machine 200 by way of discharging tube 172, circulation pump 170, and drain tube 174.

As described above, the pulsator of the present invention separately receives and washes delicate or small-sized articles, which are floating on the surface of the washing liquid in the direction of the liquid flow if they are placed in the spin tub, so the washing effect thereof is improved.

Furthermore, the articles placed in the chamber of the pulsator are subjected to a relatively small centrifugal force, so the small-sized articles can be prevented from tangling with each other and prevented from being damaged.

In addition, the pulsator of the present invention has a simple construction and can be easily manufactured by molding process, so the manufacturing cost thereof is reduced.

While the present invention has been particularly shown and described with reference to a preferred embodiment thereof, it will be understood by those skilled in the art that various changes in form and detail may be effected therein without departing from the spirit and scope of the invention as defined by the appended claims.

What is claimed is:

1. A pulsator for a washing machine, the pulsator comprising:

a rotating disc;

a cylindrical member integrally formed at a center of an upper surface of the rotating disc, the cylindrical member extending upward by a predetermined length and having a chamber for receiving an article to be washed therein;

a first means for preventing the article received in the chamber from coming out of the chamber, the first means including a hemisphere lid detachably coupled to an upper surface of the cylindrical member;

a second means for hingedly coupling the hemisphere lid to the upper surface of the cylindrical member, the second means including a pair of links integrally formed at the upper surface of the cylindrical member, a projection which is integrally formed at the underside of the hemisphere lid and interposed between the pair of links, and a hinge pin for coupling the pair of links with the projection; and a plurality of vanes for generating a swirl shaped liquid flow, the vanes being regularly installed around an outer wall of the cylindrical member, wherein the cylindrical member is formed at a first predetermined portion of an upper surface thereof with a locking hole, and the hemisphere lid is integrally formed at a second predetermined portion of an underside thereof with a locking pin which is detachably engaged with the locking hole.

2. The pulsator as claimed in claim 1, wherein the pulsator has four vanes which are regularly spaced apart from each other by an angle of 90 degrees.

3. The pulsator as claimed in claim 1, wherein the cylindrical member is formed at its outer wall with a plurality of holes for introducing/discharging a washing water into/from the chamber.

4. The pulsator as claimed in claim 1, wherein the pair of links are disposed at a first position opposite to a second position of the locking hole, and the projection is disposed at a third position opposite to a fourth position of the locking pin.

* * * * *